US005509825A

United States Patent [19]

Reider et al.

[11] Patent Number: 5,509,825

[45] Date of Patent: Apr. 23, 1996

[54] HEADER ASSEMBLY HAVING A QUICK CONNECT FILTER PACK

[75] Inventors: Christopher G. Reider, Boardman; Ralph J. Polehonki, Vienna; Bart T. Wilking, Carrollton, all of Ohio

[73] Assignee: General Motors Corporation, Detroit, Mich.

[21] Appl. No.: 338,309

[22] Filed: Nov. 14, 1994

[51] Int. Cl.[6] ..... H01R 13/66

[52] U.S. Cl. ..... 439/620

[58] Field of Search ..... 439/620; 333/181–185

[56] References Cited

U.S. PATENT DOCUMENTS

| | | | |
|---|---|---|---|
| 4,500,159 | 2/1985 | Briones et al. | 439/620 |
| 5,079,671 | 1/1992 | Garrett et al. | 361/331 |
| 5,082,457 | 1/1992 | Wollscheidt et al. | 439/620 |
| 5,141,454 | 8/1992 | Garrett et al. | 439/620 |
| 5,219,305 | 6/1993 | Kawaguchi et al. | 439/620 |
| 5,266,054 | 11/1993 | Duncan et al. | 439/620 |

*Primary Examiner*—Gary F. Paumen
*Attorney, Agent, or Firm*—William A. Schuetz

[57] ABSTRACT

A filtered header assembly for connection to a printed circuit board having a plurality of circuit traces thereon comprises a connector housing carrying a plurality of spaced pin terminals whose ends remote from the connector housing are adapted to be electrically connected to the circuit traces on the printed circuit board and a filter means including capacitors operatively connected with the pins and a ground for filtering electrical noise passing through the pins. The filter means comprises a filter pack subassembly which is simultaneously slidably connected to each of the plurality of pins and with the filter pack subassembly including a housing means having a plurality of openings therethrough through which the pins extend, an array of spaced capacitors in the housing and located adjacent said pins and biasing means for biasing the array of capacitors into engagement with the pins.

9 Claims, 4 Drawing Sheets

HEADER ASSEMBLY HAVING A QUICK CONNECT FILTER PACK

The present invention relates to a filtered header assembly for a printed circuit board and, more particularly, to a filtered header assembly having a preassembled filter pack subassembly including a capacitor array which can be readily and operatively connected to a row of pins of the header assembly without the need for any soldering.

BACKGROUND OF THE INVENTION

On various existing printed circuit boards, such as those having an array of electronic devices or components thereon, high frequency electrical interference or noise can be emitted. This noise can be detrimental to the circuitry on the printed circuit board because it can distort or interrupt a signal being transmitted. The circuits on the printed circuit boards are usually connected to external wiring harnesses via a header assembly.

One common type of header assembly comprises a connector body having a plurality of openings therethrough for receiving a plurality of pin terminals. The pin terminals have one end soldered to the individual circuits on the circuit board and the other end connectable to an external wiring harness.

To minimize the electrical noise from being emitted, it is common to house the circuit boards and the header assembly in a metal or aluminum box. However, these boxes have openings therein to allow the wiring harness to be connected to the header assembly and through which electrical noise can be emitted. An additional way to minimize the emission of electrical noise through the opening in the box is to metal plate the header assembly. However, even with these measures, electrical noise can still be transmitted through the metal pins extending from the printed circuit board to the external wiring harness. Electrical noise transmitted through the pins externally of the metal box can be transmitted throughout an automotive vehicle where it may cause disturbances in some of the circuitry of the vehicle.

To overcome electrical noise transmitted through the metal pins of a header assembly, it is common to provide a "pi" filter operatively associated with the metal pins of the header assembly. One common type of "pi" filter employs a combination of chip capacitors and a ferrite block. The ferrite block is connected to the metal pins intermediate their ends and serves as an inductor that is placed between chip capacitors which are individually soldered on the connector header on its side for connection with a wiring harness and another set of individual chip capacitors soldered on the circuit board to which the header connector is mounted or attached. This combination of capacitors and inductor creates a "pi" filter to reduce and eliminate any electrical noise being emitted through the metal pins.

A disadvantage of this type of filter is that it is costly due to the amount of precision soldering that is required. Each capacitor must be soldered to two metal pads on either the header or the printed circuit board. With the high number of circuits being used this creates a larger amount of soldering. To accomplish this, expensive high technology machinery is employed to solder the capacitors accurately on an assembly line basis in order to produce quality parts. In addition, the capacitors on the circuit board use valuable space on the printed circuit board. Without the capacitors present this space could be used for more circuitry or other electronic components.

SUMMARY OF THE INVENTION

In accordance with the provisions of the present invention, a novel filter pack or filter pack subassembly is provided which can be readily, slidably and operatively connected to a row of pins of a header assembly without the need for any soldering. The filter pack can be used with conventional or standard header assemblies for connection to a printed circuit board having a plurality of circuit traces thereon. The header assembly will comprise a connector housing for carrying a plurality of spaced pin terminals in rows and whose end remote from the connector housing are adapted to be electrically connected to the circuit traces on the circuit board. The novel filter pack is simultaneously slidably connected to each of the plurality of pins of each row of pins and readily connected to the header housing. The filter pack includes a housing means having a plurality of openings therethrough through which the pins extend, an array of spaced capacitors in the housing and located adjacent to said pins and a biasing means for biasing said array of capacitors into engagement with the pins.

The capacitor array comprises an elongated dielectric member of rectangular cross sectional shape and which has a first side which is plated with metal for engagement with the biasing means and a ground and a second opposite side which is plated with metal at longitudinally spaced locations so that a plurality of capacitors are formed at longitudinally spaced locations to provide a unitary capacitor array. The unitary capacitor array is slidably supported in a housing for limited movement toward and from the pins. The biasing means comprises a spring means including an elongated resilient metal strip in contact with a side wall of the housing and having reversely bent, leaf spring portions in engagement with the first metal side of the capacitor array.

In addition, the filter pack includes an elongated, resilient elastomeric "zebra" strip of rectangular cross sectional shape located between the capacitor array and an adjacent row of the pins. The "zebra" strip is resilient and comprises alternate sections of electrically conducting and nonconducting polymer material extending longitudinally therealong and with the electrically conducting sections being aligned with the longitudinally spaced metal locations of the capacitor array and the pin terminals. The "zebra" strip is compressed between the pins and the capacitor array when the filter pack is attached to the pins due to the leaf spring portions exerting a biasing force against the capacitor array and the "zebra" strip.

The housing means of the filter pack comprises a first, generally U-shaped housing member for slidably receiving the resilient spring biasing means, the capacitor array and the "zebra" strips. Once these three items are assembled in the U-shaped housing portion, a cover for covering the same and holding them in place is provided, the cover being snap fittingly engaged with the lower housing portion. The biasing means also includes an externally extending ear for attachment via a fastener to the header connector to a ground.

The filter pack when slidably connected to the header pins provides a ground path for electrical noise from the pins through the conductive sections of the "zebra" strip to the capacitors and then via the biasing means to a ground plane.

The advantages of the novel filter pack is that it can be readily connected to all of the pins simultaneously, it does not require any soldered chip capacitors on the printed circuit board and frees up additional space on the printed circuit board for other components. In addition, the cover of the housing means of the filter pack can be recesses to receive a ferrite block which can be readily connected simultaneously to each of the pins of the header assembly prior to attaching the filter pack and then with the ferrite block being received within the recess in the top cover of the housing means.

BRIEF DESCRIPTION OF THE DRAWINGS

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which.

DETAILED DESCRIPTION OF THE PREFERRED EMBODIMENT

Figure 1:
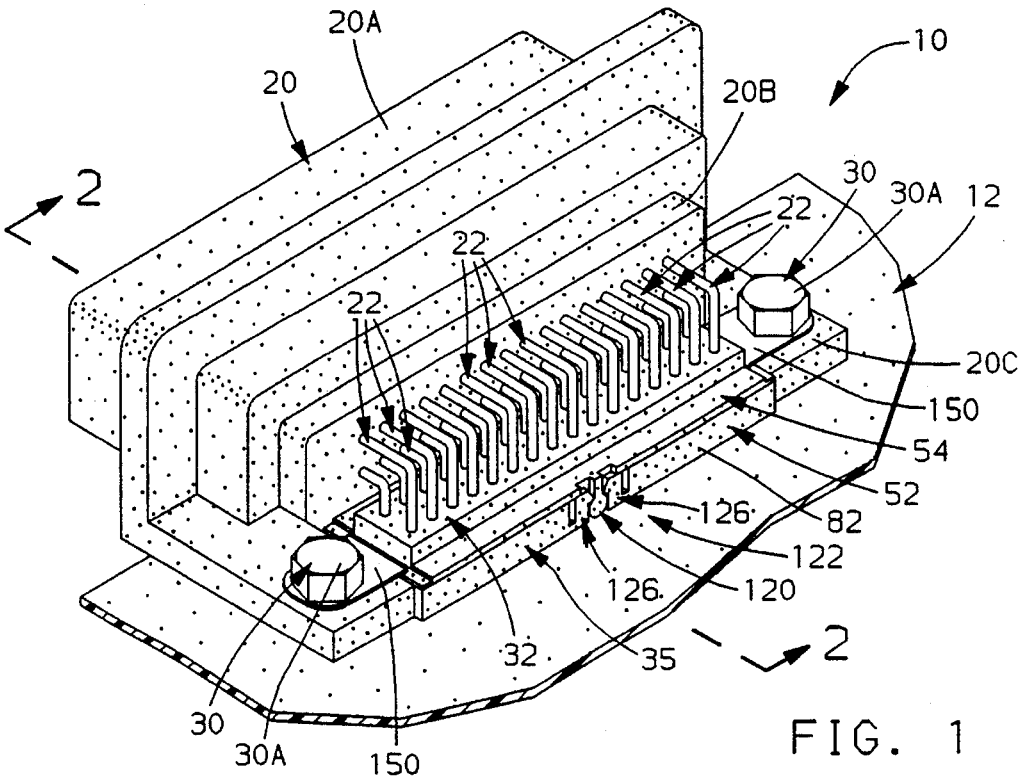
FIG. 1 is a fragmentary perspective view of a filtered header assembly embodying the novel filter pack of the present invention and showing the same being attached to a printed circuit board.
Figure 2:
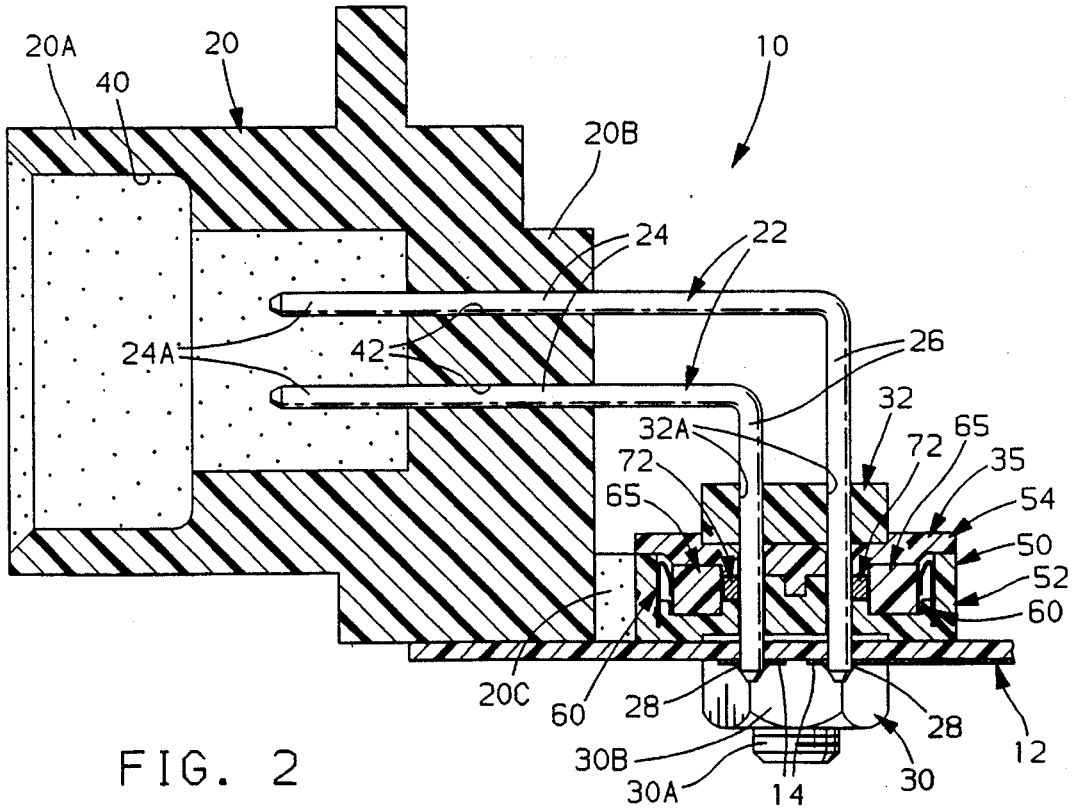
FIG. 2 is an enlarged cross-sectional view taken approximately along line 2—2 of FIG. 1.

Referring to FIGS. 1 and 2 of the drawings, a filtered header assembly 10 is thereshown for connection to a printed circuit board 12 having a plurality of circuit traces 14 thereon, as shown in FIG. 2. The header assembly 10 comprises, in general, a header connector or housing 20, a pair of rows of pin terminals 22 having forward portions 24 which are carried by the header connector 20 and rearward portions 26 at right angles to the forward portions 24 and which extend through openings in the circuit board 12 and are soldered to the traces 14 on the circuit board 12, as indicated by reference numeral 28, fastener means 30 for securing the connector body 20 to the circuit board 12, a ferrite block 32 operatively connected to the rearward portions 26 of the pin terminals 22, and a filter pack or filter pack subassembly 35 which is operatively connected with the rearward portions 26 of the pin terminals 22 and which is secured to the connector body 20 by the fastening means 30.

The connector body 20 is of a one piece molded plastic construction and includes a forward portion 20A which defines a larger central cavity 40 and a rearward portion 20B having a plurality of openings 42 extending therethrough which receives the forward portions 24 of the pin terminals 22. The pin terminals 22 are suitably retained in the rearward portion 20B of the connector housing 20 so that the forward end portions 24A of the pins 22 are located within the cavity 40 of the forward portion 20A of the connector housing 20. The forward portion 20A of the connector housing 20 is adapted to receive a suitable wiring harness connector (not shown) having a plurality of socket terminals (not shown) which are adapted to mate with the forward end portions 24A of the pin terminals 22 when the harness is inserted within the cavity 40 of the connector body 20. The forward end portions 24A of the pin terminal 22 would be operatively connected to chip capacitors (not shown) and in a manner which is conventional in the art.

The connector body 20 is suitably secured to the printed circuit board 12 via the fastening means 30. The fastening means 30 comprises a pair of bolts 30A and nuts 30B, the bolts 30A extending through aligned openings (not shown) in legs 20C of the connector housing 20 and the printed circuit board 12. The nuts 30B would engage a suitable ground trace or plane (not shown) on the bottom of the circuit board 12 when the connector housing 20 is bolted thereto. The outer surface of the connector housing 20 could be metal plated so as to provide a shield against electrical noise, if desired.

The ferrite block 32 is a rectangular block made from a suitable ferritic material and which has a plurality of openings 32A extending therethrough through which the pins 22 at their rearward portions 26 extend. The ferrite block 32 is operatively connected to the pin terminals 22 serves as an inductor for a "pi" filter between the chip capacitors (not shown) at the forward end 24A of the pin terminals 22 and the filter pack 35 at the rearward end 26 of the pin terminal 22.

In accordance with the provisions of the present invention, a novel filter pack or filter pack subassembly 35 is provided which can be readily and simultaneously attached to all of the pins 22 and which functions to filter out any electrical noise travelling through the pins 22. The filter pack 35 is used in lieu individual chip capacitors soldered to the circuit board 12 and operatively connected with the individual pins 22.

Figure 3:
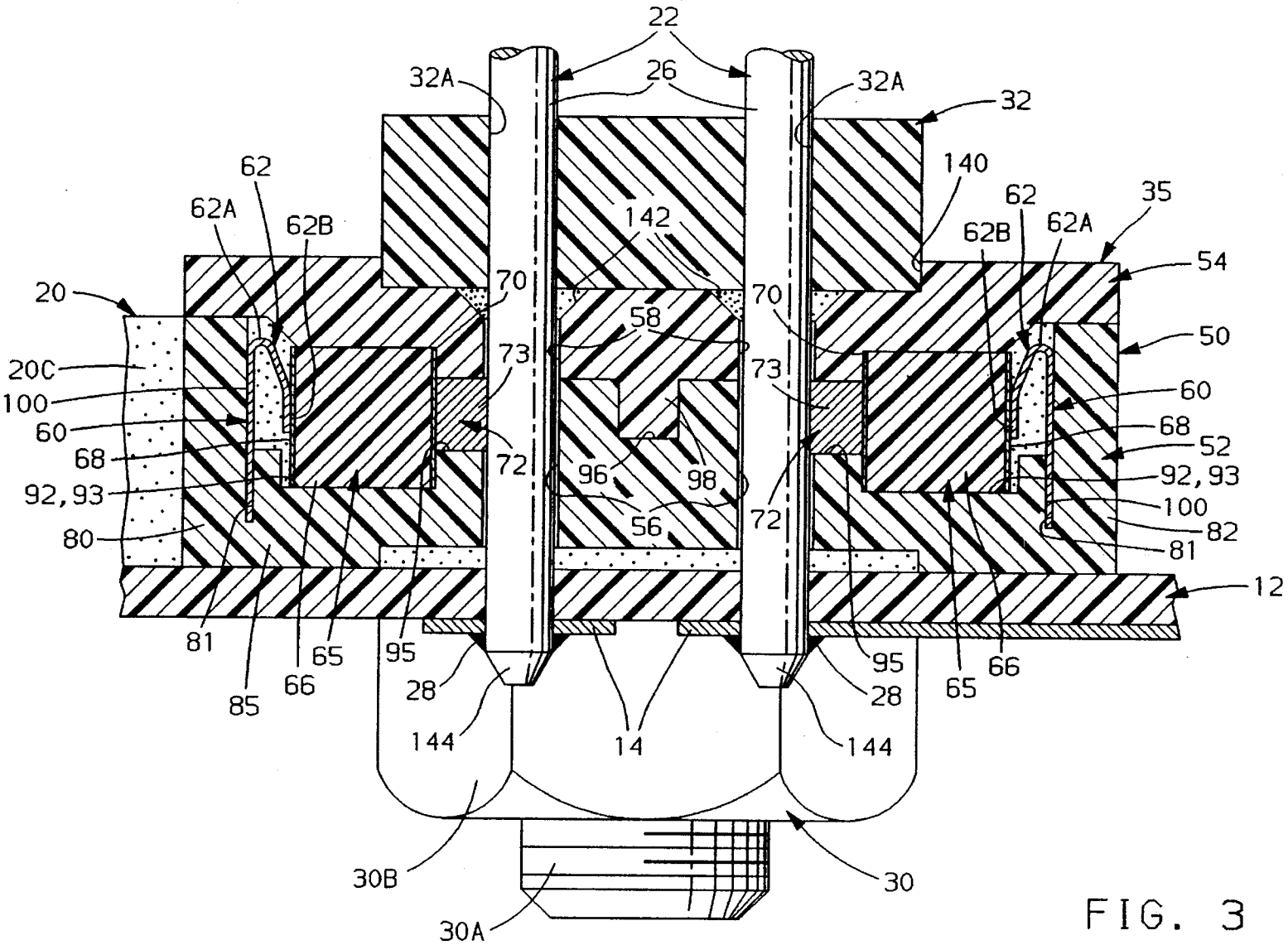
FIG. 3 is an enlarged fragmentary sectional view of part of the header assembly shown in FIG. 2.
Figure 4:
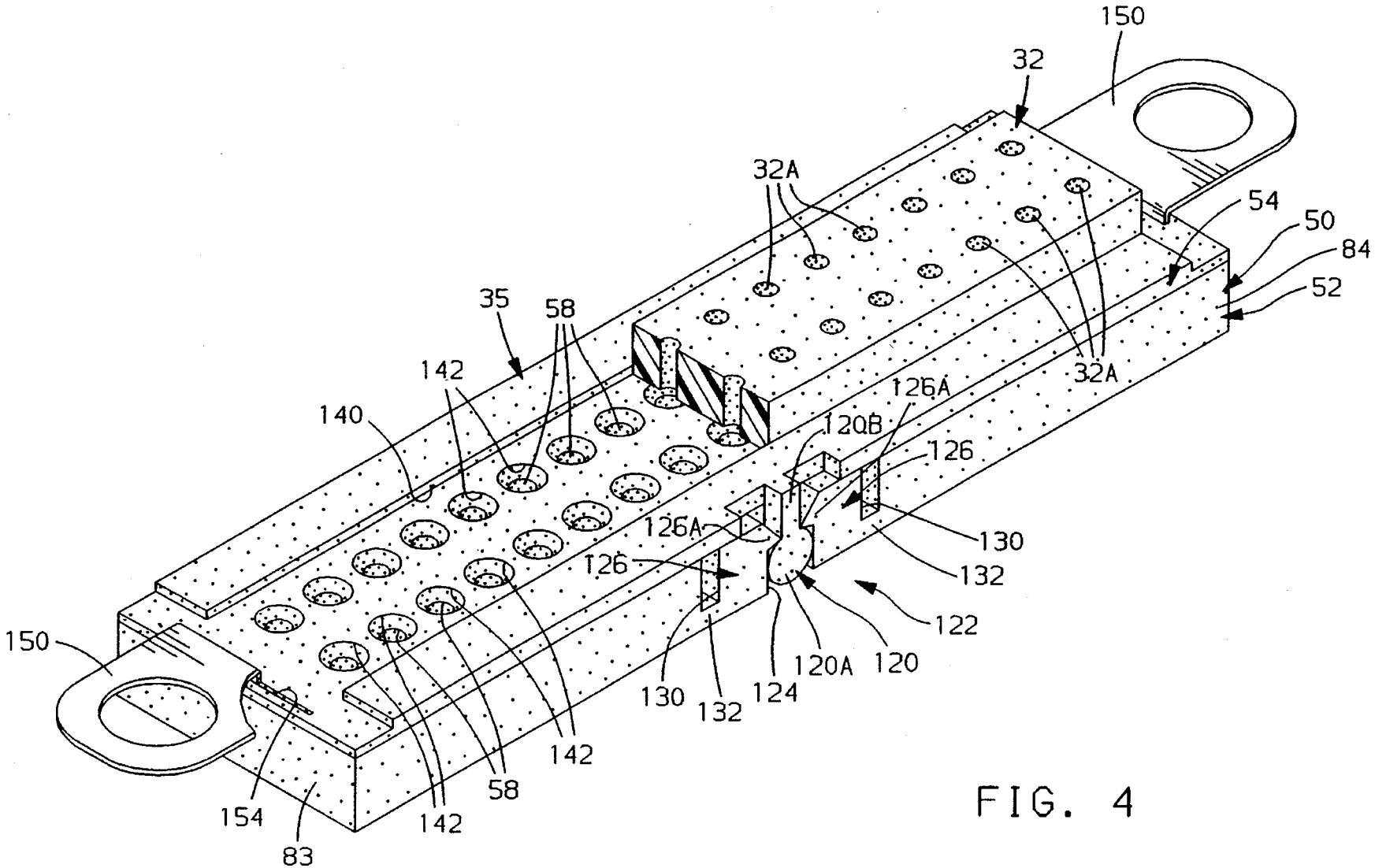
FIG. 4 is an enlarged perspective view, with portions shown in section, of the novel filter pack of the present invention.
Figure 5:
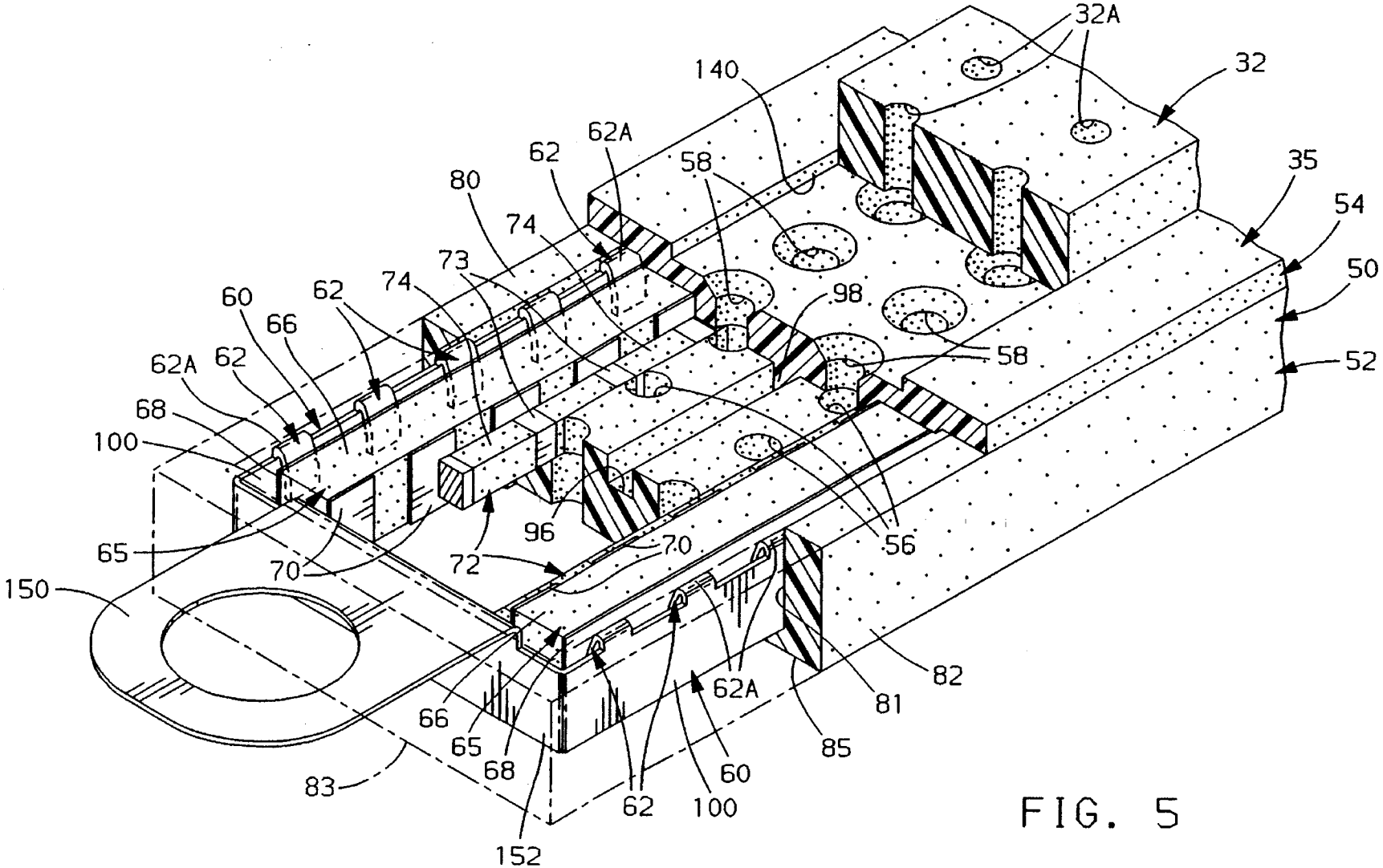
FIG. 5 is an enlarged fragmentary perspective view, with portions shown in section of the novel filter pack as shown in FIG. 4.

As best shown in FIGS. 3–5, the filter pack subassembly 35 comprises a rectangularly shaped housing means 50 having a main housing 52 and a cover 54 which have aligned openings 56, 58 therethrough for receiving the rows of pin terminals 22, a pair of resilient U-shaped metal strips 60 having a plurality of longitudinally spaced leaf spring portions 62 received within the housing 52, capacitor arrays 65 comprising an elongated rectangularly shaped dielectric member 66 which is fully plated on one side, as indicated by reference numeral 68, and Which is plated at longitudinally spaced locations at its opposite side, as indicated by reference numerals 70, and resilient elastomeric "zebra" strips 72 having alternately spaced, electrically conductive and non-conductive sections 73, 74 at spaced longitudinal locations therealong and which engage the rows of pin terminals 22. It should be noted that the sections 73, 74 would be the same in appearance, but to illustrate the sections 73, 74, they are shown in FIG. 5 as being stippled and unstippled, respectively. The capacitor arrays 65 are slidably supported by the housing 52 for limited movement toward and from their adjacent row of pins 22 and are spring biased by the leaf spring portions 62 of the U-shaped metal members 60 toward the pins 22 and with the conductive portions 73 of the elastomeric strips 72 being compressed between the capacitor arrays 65 and the pin terminals 22 to provide a ground path for electrical noise from the pin terminals 22 via the conductive portions 73 of the "zebra" strips through the capacitor arrays 65 to the U-shaped metal members 60, the latter in turn being connected to a ground via the fastening means 30.

The housing member 52 comprises a one piece rectangularly shaped member having a pair of side walls 80, 82, a pair of end walls 83, 84 and a bottom or bottom wall 85. The bottom 85 has a rectangular vertically extending slot 81, the slot extending adjacent the side walls 80, 82 and along or adjacent the end walls 83, 84. The bottom 85 spaced inwardly from the side walls 80, 82 has elongated recesses or troughs 92 whose bottom surfaces 93 are flat. Between the recesses 92 and the pins 22, the bottom 85 of the housing 52 defines a ledge 95 which is spaced upwardly from the bottom surfaces 93 of the recesses 92. The bottom 85 between the rows of pins 22 has a rectangularly shaped recess 96 which extends the entire length of the bottom 85 and which is adapted to receive an elongated rib 98 on the bottom side of the cover 54 and in a manner to be hereinafter more fully described.

Each of the U-shaped resilient metal members 60 has a planar base 100 which lies against the inner surface of the side walls 80, 82 and either one of the end walls 83, 84. The U-shaped member 60 is shaped complementary to the slot 81 and has its base slidably received within the slot 81 when moved vertically downward against the bottom 85 of the housing 52. The planar base 100 at spaced longitudinal locations therealong has integrally formed, reversely bent leaf springs 62. The leaf springs 62 are reversely bent to define a bight 62A with the base 100 at the upper end of the base 100 and a flat free end portion 62B for engaging the capacitor array 65. The leaf springs 62 are disposed within the space between the side walls 80 or 82 and the recesses 92 for receiving the capacitor array 65. The leaf springs 62 serve to bias the capacitor array 65 towards the pin terminals 22.

The capacitor array 65 comprises a one piece, elongated, dielectric member made from a suitable ceramic or other dielectric material which is rectangular in shape, as viewed in cross section. The capacitor array 65 is insertable into the housing portion 52 from above and is slidably received on the bottom surface 93 of one of the recesses 92. The capacitor arrays 65 are fully metal plated on its side facing the leaf spring 62, as indicated by reference numeral 68, to form a ground plane that engages the leaf springs 62 of the U-shaped members 60. The capacitor arrays 65 on their opposite side, i.e., the sides facing the pins 22, are plated only at spaced longitudinal locations, as indicated by reference numeral 70. The plated locations 70 in conjunction with the ground planes 68 form individual capacitors at longitudinally spaced locations along the dielectric material 66. The number of capacitors formed is equal to the number of metal pins 22. As noted before, the capacitor arrays 65 are supported on the bottom surfaces 93 of the recesses 92 for limited sliding movement toward and from the associated pin terminals 22 by the leaf springs 62.

The "zebra" strips 72 comprise elongated, resilient, elastomeric, rectangularly shaped members and are supported on the ledges 95 of the bottom 85 of the housing 52. The strip 72 comprises alternately spaced rectangularly shaped electrically conductive and electrically non-conductive polymer sections 73, 74. The conductive sections 73 have metal flakes dispersed therethrough to make them electrically conductive. Each of the electrically conductive sections 73 are in contact with one of the pins 22 and one of the capacitor at plated locations 70 of the capacitor arrays 65. The non-conductive sections 74 provide an electrically insulated barrier between the conductive sections 73 so that current can only flow through the conductive sections 73.

The cover 54 is generally rectangular in shape and overlies the housing 52. As noted before, the cover 54 includes a depending rib 98 which is slidably received within the recess 96 to accurately locate the cover on the housing 52.

The cover 54 is attached to the housing 52 via a pair of cooperable snap fit fasteners 122 located at opposite sides of the housing means 50. The cooperable snap fit fasteners 122 (only one of which is shown in the drawings) comprise an integrally formed tab 120 extending downwardly from the plane of the cover 54. The tab 120 has a head 120A which is wider than its shank 120B, the shank 120B being integral with the cover 54. The housing 52 comprises a pair of recesses 124 at its opposite sides (only one of the recesses 124 is shown in the drawings). The housing 52 outer side walls 80, 82 each include a pair of spaced deflectable tabs 126 having barbs 126A which face toward each other. The housing side walls also includes pairs of slots 130 spaced from the tabs 126 and with the tabs 126 being integral with the side walls of the housing 52 only adjacent their bottom end, as indicated by reference numeral 132. The tabs 126 are deflectable toward and from each other in response to pushing the head 120A of the tab 120 downwardly past the barbs 126A. When, as shown in FIG. 4, the tab 120 is pushed downwardly past the barbs 126A, the tabs 126 will return to their normal free state position and lock behind the head 120A of the tab 120.

The cover 54 also includes a rectangular recess 140 which receives the ferrite block 32. In addition, it should be noted that the openings 58 in the cover have tapered entry ends or ramps 142 and that the pin terminals 22 at their rearward ends 26 are tapered, as indicated by reference numeral 144.

The filter pack 35 is assembled by first inserting the U-shaped members 60 having the leaf springs 62 into the slots 81. Then the capacitor arrays 65 are inserted into the recesses 92 and the "zebra" strips 72 inserted on the ledges 95. The strips 72 could be suitably adhesively secured at their opposite ends to prevent dislodgement from the ledges 95. Thereafter the cover 54 is snap fittingly connected to the housing 52 via the cooperable fasteners 122 to form the finished subassembly.

The filter pack 35 is connected to the pin terminals 22 by slidably connecting the same to the rearward end portions 26 of the pins 22. The pin terminals 22 will enter the aligned openings 58, 56 in the cover 54 and housing 52 and with the tapered ends of the pin terminals 22 engaging the strips 72 to compress the same between the capacitor arrays 65 and the pins 22 of the adjacent row of pins 22. The leaf springs 62 function to bias the capacitor arrays 65 into engagement with the strips 72 which in turn are compressed and held in conductive engagement with the pins 22, since the conductive sections 73 thereof are aligned with the pins 22.

It should be noted that the U-shaped members 60 each include a tab or ear 150 integral with its bight portion 152 which can be inserted through a slot 154 in the cover 54 and then bent at right angles. These tabs 150 include a central through opening through which the fastening means 30 can be inserted. As shown in FIG. 1, when the bolt 30A of the fastening means 30 is inserted through the tab 150 and the nut 30B is fastened to the underside of the printed circuit board 12, a ground connection from the U-shaped members 60 to the circuit board 12 is established via the fasteners 30 and tabs 150. In addition, if the connector housing 20 itself is externally plated with a metallic material, a ground connection is also made therewith from the tabs 150.

In operation, any electrical noise travelling along the pin terminals 22 will follow a ground path from the pin terminals 22, the adjacent conductive sections 73 of the strips 72, the adjacent capacitor at plated locations 70 of the capacitor array 65 to the leaf springs 62 of the U-shaped members 60 and then to ground through the fastener 30.

From the foregoing, it should be apparent that a novel filter pack subassembly 35 for use in a filtered header assembly has been provided. The filter pack 35 eliminates the need for individual chip capacitors to be soldered onto the circuit board 12 in connection with each of the pin terminals 22. This not only eliminates many soldering operations, it also frees up space on the circuit board 12 for other electrical components or devices and thus provides for a more compact assembly.

Although the illustrated embodiment hereof has been described in great detail, it should apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. A filtered header assembly for connection to a printed circuit board having a plurality of circuit traces thereon comprising a connector housing for carrying a plurality of spaced pin terminals whose ends remote from the connector housing are adapted to be electrically connected to said circuit traces on said printed circuit board, and filter means including capacitors operatively connected with said pins and a ground for filtering electrical noise passing through said pins, the improvement being that said filter means comprises a filter pack subassembly which is simultaneously slidably connected to each of said plurality of pins, said filter pack subassembly including a housing means having a plurality of openings therethrough through which the pins extend, an array of spaced capacitors in said housing and located adjacent said pins and biasing means for biasing said array of capacitors into engagement with said pins.

2. A filtered header assembly for connection to a printed circuit board having a plurality of circuit traces thereon comprising a connector housing for carrying a row of spaced pin terminals whose ends remote from the connector housing are adapted to be electrically connected to said circuit traces on said printed circuit board, means for connecting said header assembly to said printed circuit board and filter means including capacitors operatively connected with said pins and a ground for filtering electrical noise passing through said pins, the improvement being that said filter means comprises a filter pack subassembly which is simultaneously slidably connected to each of said row of pins, said filter pack subassembly including a housing means having a row of spaced openings therethrough through which said row of pins extend, a capacitor array comprising an elongated dielectric member supported by said housing means and having a first side covered with metal to provide a ground and a second opposite side which is coated with metal at longitudinally spaced locations so that a plurality of longitudinally spaced capacitors are formed as a unitary capacitor array, said capacitor array being located adjacent to and having its second side facing said pins, an elongated, elastomeric strip having alternate sections of electrically conducting and non-conducting polymer material located between said capacitor array and said pin terminals and with the conducting sections engaging said capacitor array at said longitudinally spaced locations on its other side and said pin terminals, and biasing means for biasing said second side of said array of capacitors and said elastomeric strip into engagement with said pins.

3. A filtered header assembly, as defined in claim 2, and wherein said biasing means includes a plurality of leaf springs spaced longitudinally along said capacitor array and which engage the first side of the capacitor array.

4. A filtered header assembly, as defined in claim 2, and wherein said biasing means comprises a planar base which abuts a side wall of the housing means and a plurality of reversely bent leaf springs integral with said base and spaced apart longitudinally therealong, the leaf springs engaging said first side of said capacitor array at spaced locations therealong.

5. A filtered header assembly, as defined in claim 4, and wherein said housing means comprises a housing member for supporting said biasing means, capacitor array and strip and a cover overlying said housing member to retain said biasing means, capacitor array and strip in place.

6. A filtered header assembly, as defined in claim 5, and wherein said cover is connected to and retained on said housing member by cooperable snap fitting fasteners on said housing member and said cover.

7. A filtered header assembly, as defined in claim 2, and including a ferrite block connected to said pins between said connector housing and said filter pack subassembly, and wherein said housing member of said filter pack subassembly has a recess shaped complementary with said ferrite block for receiving the ferrite block.

8. A filtered header assembly for connection to a printed circuit board having a plurality of circuit traces thereon comprising a connector housing for carrying a plurality of spaced pin terminals whose ends remote from the connector housing are adapted to be connected to said circuit traces on said printed circuit board, means for connecting said header assembly to said printed circuit board and filter means including capacitors operatively connected with said pins and a ground for filtering electrical noise passing through said pins, the improvement being that said filter means comprises a filter pack subassembly which is simultaneously slidably connected to each of said plurality of pins, said filter pack subassembly including a housing member having a side wall, a bottom and an open top, said housing having a plurality of spaced openings extending through its bottom for receiving said pins, said side wall and bottom defining a first elongated channel and said bottom having a second elongated channel adjacent said first channel and a ledge adjacent to and extending transversely from said second channel to said openings in said bottom, biasing means including an elongated resilient metal strip in contact with said side wall of said housing and having reversely bent, downwardly extending leaf spring portions disposed in said first channel, a capacitor array comprising an elongated dielectric member of rectangular cross sectional shape and having a first side which is plated with metal for engagement with said leaf spring portions and a second opposite side which is plated at longitudinally spaced locations so that a plurality of capacitors are formed at longitudinally spaced locations to provide a capacitor array, said capacitor array being slidably received within said second channel of said housing member and being movable laterally of said channel a limited extent, an elongated strip of rectangular cross sectional shape on said ledge of said bottom of said housing member, said strip being resilient and comprising alternate sections of electrically conducting and non-conducting polymer material, the electrical conducting sections being aligned with the spaced plated locations of said capacitor array and said pin terminals, and a cover having a plurality of through openings for receiving said pin terminals and which are aligned with the openings in the bottom of said housing member, said cover overlying said open top of said housing member and being snap fittingly connected to said housing member to retain the biasing means, capacitor array and elongated strip in place, said strip being compressed between said pins and said capacitor array when said filter pack subassembly is attached to said pins due to leaf spring portions exerting a biasing force against said capacitor array and said strip, said electrically conductive sections of said strip being electrically conductive only in the direction between said pin and said capacitor array.

9. A filtered header assembly, as defined in claim 8 and wherein said metal strip of said biasing means is U-shaped and has an integral ear which extends through a slot in said cover for connection to a ground on said circuit board.

* * * * *